US007934827B2

(12) United States Patent
Ishii et al.

(10) Patent No.: US 7,934,827 B2
(45) Date of Patent: May 3, 2011

(54) PRINTER AND MEDIA PROCESSING DEVICE

(75) Inventors: Hiroshi Ishii, Matsumoto (JP); Koichi Ebina, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 770 days.

(21) Appl. No.: 11/998,571

(22) Filed: Nov. 30, 2007

(65) Prior Publication Data

US 2008/0136885 A1 Jun. 12, 2008

(30) Foreign Application Priority Data

Dec. 7, 2006 (JP) ..... 2006-330164

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS

| | | | | |
|---|---|---|---|---|
| 5,914,918 | A | 6/1999 | Lee et al. | |
| 6,400,659 | B1 | 6/2002 | Kitaoka | |
| 6,760,052 | B2 * | 7/2004 | Cummins et al. | 347/171 |
| 6,988,838 | B2 | 1/2006 | Inokuchi et al. | |
| 7,061,515 | B2 * | 6/2006 | Cummins et al. | 347/171 |
| 7,209,156 | B2 * | 4/2007 | Cummins et al. | 347/171 |
| 7,301,550 | B2 * | 11/2007 | Cummins et al. | 347/171 |
| 7,748,807 | B2 * | 7/2010 | Jones et al. | 347/2 |
| 2006/0209102 | A1 * | 9/2006 | Jones et al. | 347/4 |
| 2007/0109381 | A1 * | 5/2007 | Liao et al. | 347/101 |

FOREIGN PATENT DOCUMENTS

| | | |
|---|---|---|
| JP | 2000-260172 | 9/2000 |
| JP | 2002-292938 | 10/2002 |
| JP | 2002-292939 | 10/2002 |
| JP | 2004-34389 | 2/2004 |

* cited by examiner

*Primary Examiner* — Charlie Peng
(74) *Attorney, Agent, or Firm* — Michael T. Gabrik

(57) ABSTRACT

The direction in which the media tray 21 moves in and out of the printer and the direction in which the inkjet head 17 moves when printing are on the same line along the front-to-back axis Y of the label printer 5, and the written medium 2B carried on the media tray 21 is positioned on the printing line of the inkjet head 17 when the media tray 21 moves to the tray retraction position 21A. Moving the media tray 21 retracted inside the printer widthwise to the printer from the tray retraction position 21A to the printing position is unnecessary, and printing can start immediately while moving the media tray 21 from the tray retraction position 21A on the widthwise axis X of the printer. The width of the label printer 5 can be reduced because the media tray 21 moves only the diameter of the media widthwise to the printer.

8 Claims, 5 Drawing Sheets

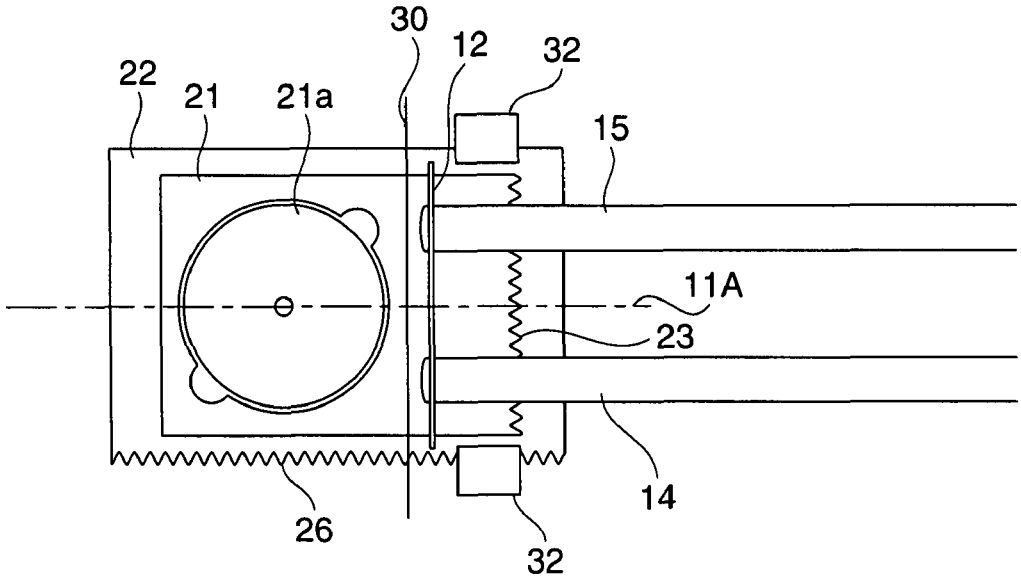
FIG. 5
FIG. 6A
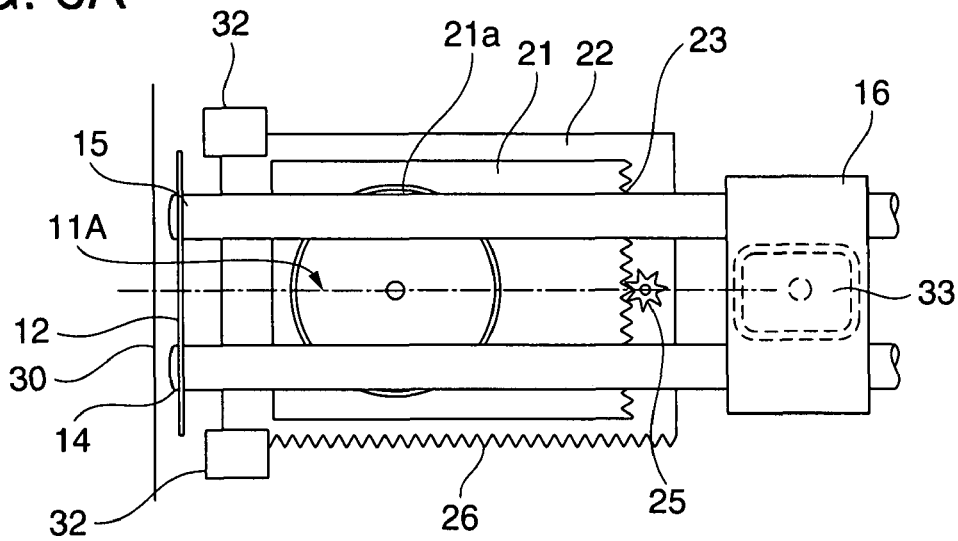
FIG. 6B
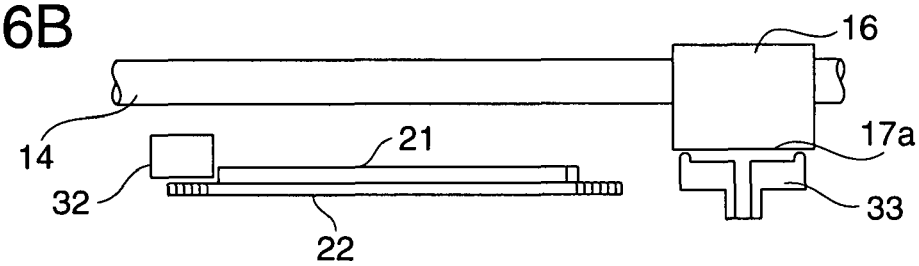

PRINTER AND MEDIA PROCESSING DEVICE

BACKGROUND OF THE INVENTION

1. Field of Invention

The present invention relates to a printer such as an inkjet printer for printing on the surface of media such as CD and DVD media. More particularly, the invention relates to a printer that is arranged compactly for use as a label printer in a media processing device such as a CD/DVD publisher or duplicator.

2. Description of Related Art

In a media processing device such as a CD/DVD publisher, blank CDs, for example, that are stored in a blank media stacker are typically supplied to an internal CD drive that writes prescribed data to the disc. The internal label printer of the CD/DVD publisher then prints a label on the CD label surface, and the disc is then either stored in a finished media stacker or discharged from a disc exit. U.S. Pat. No. 5,914,918 teaches this type of publisher, and a disc production device with the same arrangement is also taught in Japanese Unexamined Patent Appl. Pub. JP-A-2000-260172.

In order to achieve a compact media processing device the media stackers, media drives, and label printer must be also be compact. A serial inkjet printer is generally used as the label printer, requiring moving both the print head and the media. The label printer therefore occupies a large amount of space in the media processing device. Realizing a compact label printer is therefore a particularly effective means of achieving a compact media processing device.

Japanese Unexamined Patent Appl. Pub. JP-A-2004-34389 teaches an inkjet printer that can be compactly housed in a consumer-grade AV component rack and can print on CDs, DVDs, and other data media. This inkjet printer pulls a disc tray carrying the data media towards the back of the printer. The inkjet printer then moves the disc tray widthwise inside the printer to feed the media to the printing position of the recording head.

It is desirable for CD/DVD publishers and other media processing devices to be of minimum width. Minimizing the width of the CD/DVD publishers makes it necessary to minimize the width of the label printer as much as possible. However, printers of a narrow width suitable for use in a media processing device are not presently known in the literature.

For example, the inkjet printer taught in Japanese Unexamined Patent Appl. Pub. JP-A-2004-34389 conveys the disc tray to the printing position of the recording head along an L-shaped transportation path that first pulls the disc tray to the back of the printer and then moves the disc tray widthwise to the printer. This inkjet printer then prints while moving the disc tray across the printing position widthwise to the printer. There is, therefore, a limit to how much the printer width can be reduced and still satisfy space requirement needed to pull the disc tray into the printer and to move the disc tray bidirectionally passed the printing position.

SUMMARY OF THE INVENTION

The printer according to the present invention decreases the width of the printer to a size that is suitable for use in a media processing device.

A printer according to a first aspect of the invention has a print head, a head movement mechanism that moves the print head, a media tray on which media to be printed is placed, a tray transportation mechanism that transports the media tray passed a printing position of the print head, and a tray discharge mechanism that moves the media tray in a straight line along the direction of print head movement between a tray discharge position outside the printing position and a tray retraction position inside the printing position.

After placing a recording medium on the media tray discharged to the tray discharge position, the tray discharge mechanism of this printer retracts the media tray to the tray retraction position. Because the tray retraction position is in the printing position of the print head, the print head can immediately start printing on the medium that is held on the media tray retracted to the tray retraction position. The distance that the media tray travels inside the printer is therefore shorter than when the retracted media tray must move widthwise to the printer to the printing position of the print head. The printer can therefore be rendered compactly.

A tray discharge opening is generally formed in the front of the printer for ease of operation so that the media tray can be discharged from the front of the printer through the tray discharge opening. More specifically, the position to which the media tray is discharged outside the printer from the tray discharge opening is the tray discharge position.

The direction of print head movement is the front-to-back direction of the printer, and the direction of media tray transportation by the tray transportation mechanism is widthwise to the printer.

With this arrangement the direction of print head travel and the direction in which the media tray moves in and out of the printer are on the same front-to-back line of the printer, and when seen from the front of the printer the space for moving the print head and the media tray is contained within the space required to move the media tray widthwise to the printer. The printer width can therefore be reduced because the printer requires only enough space to move the media tray widthwise to the printer during printing.

Preferably, the printer also has a cap that covers the print head at the back of the printer opposite the tray discharge opening formed in the printer front, and the print head returns to the standby position and is covered by the cap after printing ends. Because the media tray and the cap positions thus do not overlap, the printer can be rendered compactly.

Further preferably, the tray discharge mechanism includes a tray support plate that supports the media tray slidably widthwise to the printer, a support plate guide that supports the tray support plate slidably front-to-back to the printer, a first transportation motor, and a first rack and pinion mechanism that converts and transfers the rotational force of the first transportation motor to a linear force that moves the tray support plate in the front-to-back direction of the printer.

In addition, the tray transportation mechanism includes a second transportation motor mounted on the tray support plate, and a second rack and pinion mechanism that converts and transfers the rotational force of the second transportation motor to a linear force that moves the media tray widthwise to the printer.

Further preferably, the media tray is prevented by a guide member from moving widthwise to the printer in the media tray transportation direction only while the media tray is moving front-to-back to the printer.

Yet further preferably, the guide member is positioned on both sides of a line parallel to the front-to-back direction of the printer above the media tray.

Another aspect of the invention is a media processing device having a media storage unit that stores media such as CDs and DVDs, a media drive that writes data to the media and reads data from the media, a label printer that prints on a surface of the media, and a media transportation mechanism that conveys the media, and the printer described above is used as the label printer with the width of the printer aligned with the width of the media processing device.

In the printer according to the present invention the direction of print head travel and the direction the media tray travels for loading and unloading are the same, and the media tray is set to the printing position of the print head when the media tray is retracted inside the printer to the tray retraction position. The space required for moving the media tray can therefore be reduced because once the media tray has been retracted into the printer it is only necessary to move the media tray the distance required for printing. A narrow printer can therefore be achieved if the media tray travels widthwise to the printer, and the printer can be incorporated in devices such as media processing devices that have limited installation space.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 5 shows the media tray in the discharged position.

FIG. 6 is a plan view and a front view of the main parts of the label printer after printing ends.

DESCRIPTION OF PREFERRED EMBODIMENTS

A preferred embodiment of the present invention is described below with reference to the accompanying figures.

General Configuration

Figure 1:
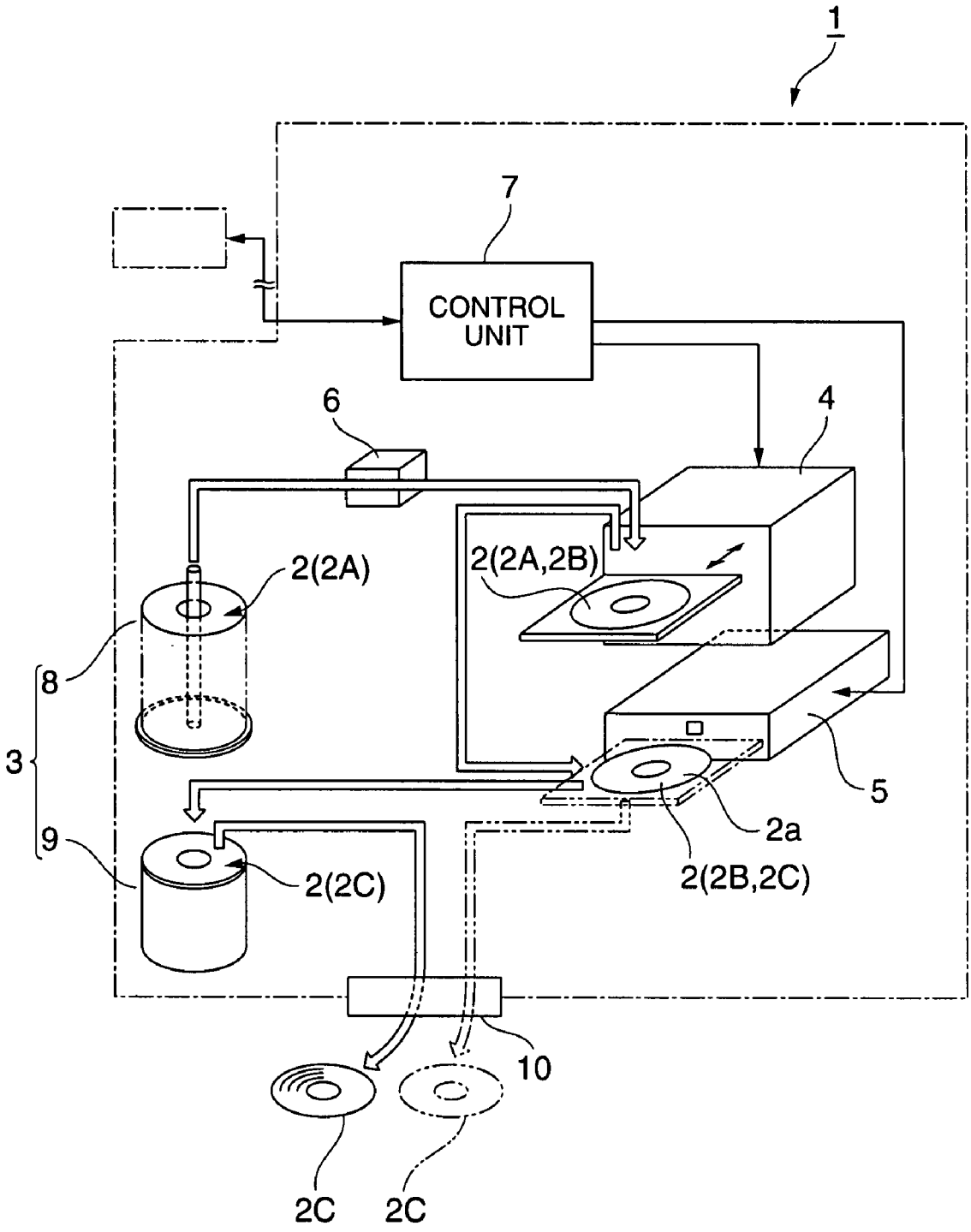
FIG. 1 is a schematic diagram of a publisher according to the present invention.

FIG. 1 is a schematic diagram of a publisher 1 according to the present invention. This publisher 1 includes a media storage unit 3 for storing media 2 (including blank media 2A and finished media 2C) such as CDs and DVDs, a media drive 4 for writing data to the media 2 and reading data from the media 2, a label printer 5, a media transportation mechanism 6 for conveying the media 2, and a control unit 7 for controlling driving the various parts. The label printer 5 prints a label containing a title describing the written content, for example, on the label surface of media 2 to which data has been recorded.

The media storage unit 3 includes a blank media stacker 8 and a finished media stacker 9. The blank media stacker 8 stores the blank media 2A in a vertical stack, and the finished media stacker 9 likewise stores the finished media 2C in a vertical stack.

The media transportation mechanism 6 can sequentially pick media 2 from the top of the stacks in the blank media stacker 8 and the finished media stacker 9, and can sequentially store the media 2 to the top of the stacks in the blank media stacker 8 and the finished media stacker 9.

When a data write command is received from a host device, the control unit 7 controls the media transportation mechanism 6 to pick and carry blank media 2A from the blank media stacker 8 of the media storage unit 3 to the media drive 4, and controls the media drive 4 to write data to the blank media 2A. The control unit 7 then controls the media transportation mechanism 6 to carry the written media 2B when writing is completed from the media drive 4 to the label printer 5, and causes the label printer 5 to print a label on the label surface of the written media 2B. When printing is completed the finished media 2C is stored by the media transportation mechanism 6 in the finished media stacker 9 or discharged from the media exit 10.

Label Printer

Figure 2A:
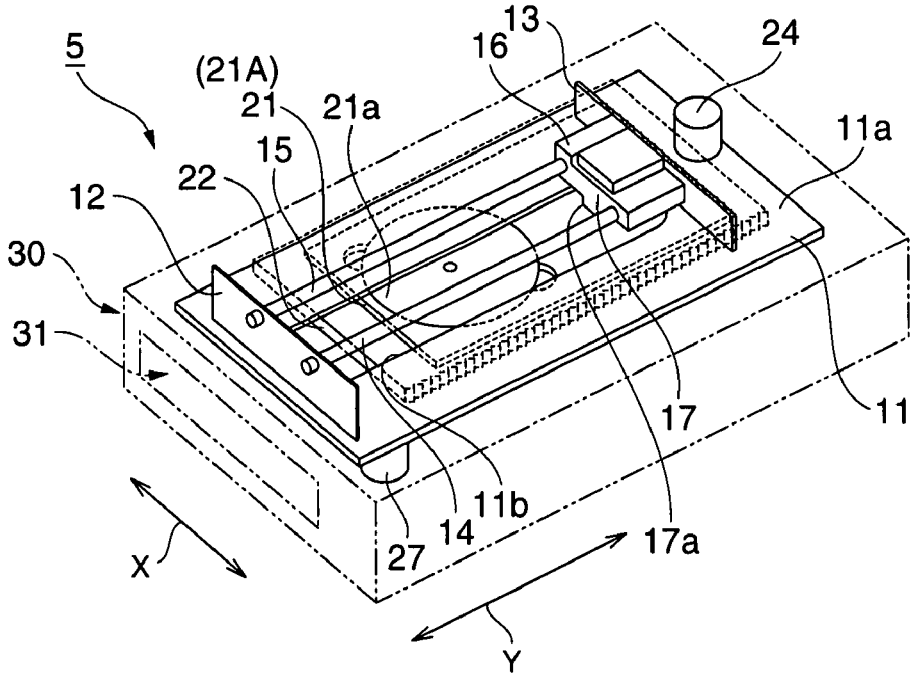
FIG. 2 is an oblique view describing the two operating states of the label printer.
Figure 2B:
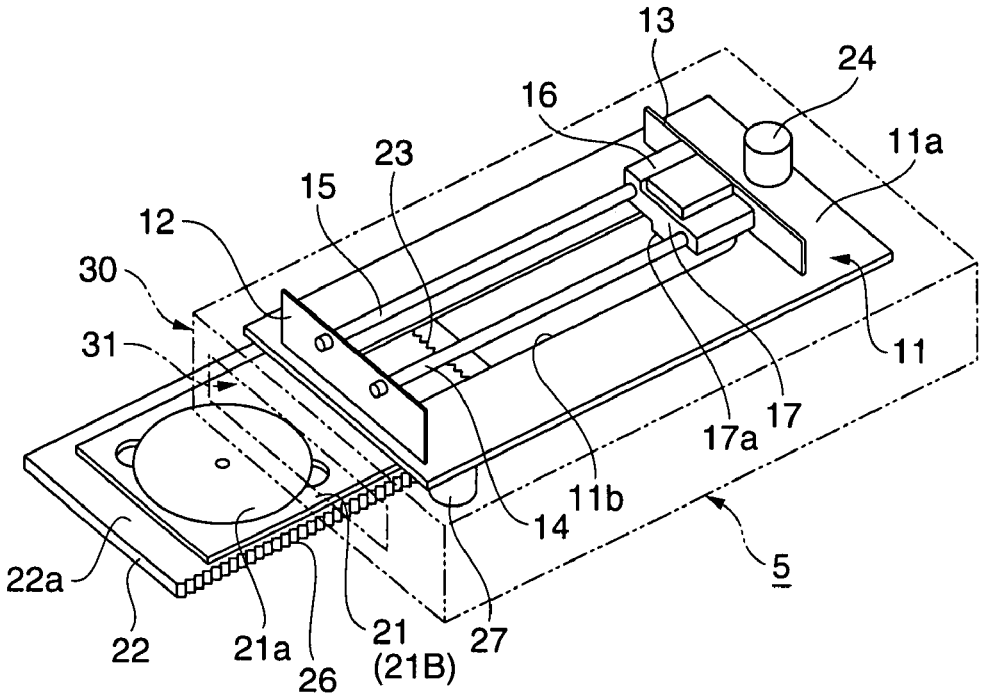
Figure 3A:
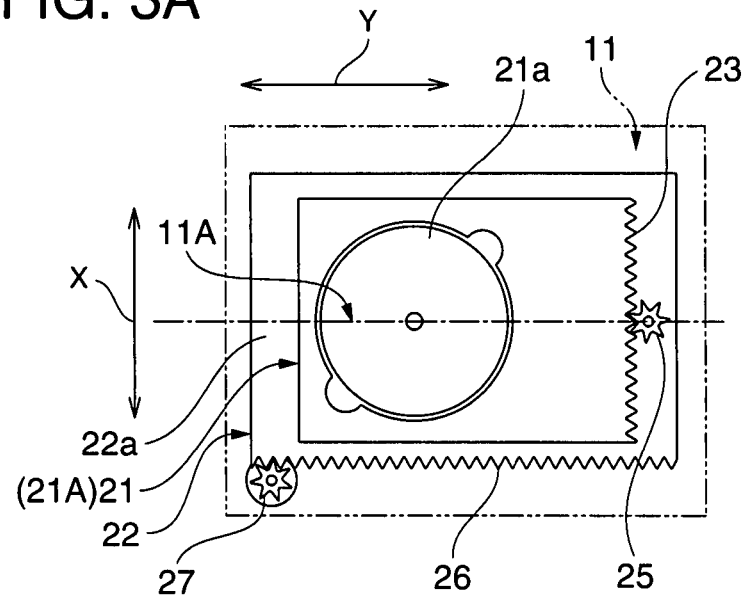
FIG. 3 is a plan view, a front view, and a side view of the main parts of the label printer.
Figure 3C:
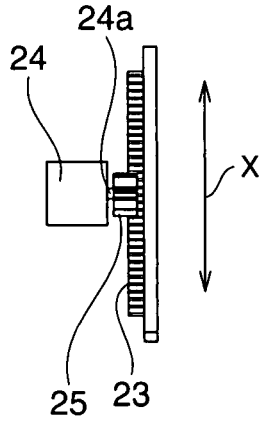
Figure 3B:
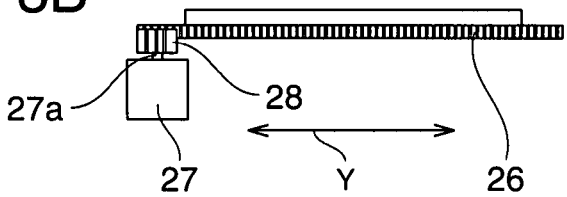

FIG. 2 is an oblique view describing the arrangement of the label printer 5 in the publisher 1. FIG. 2A shows the media tray in the tray retraction position, and FIG. 2B shows the media tray in the discharged position. FIG. 3A to FIG. 3C are respectively a plan view, a front view, and a side view from the back of the main parts of the label printer 5.

The label printer 5 in this embodiment of the invention has a flat, rectangular printer frame 11 that is long on the front-to-back axis Y of the printer. Brackets 12 and 13 extending along the widthwise axis X of the printer rise vertically at the front and back ends on the top 11*a* of the printer frame 11. Carriage guide rails 14 and 15 extend parallel to the front-to-back axis Y between these brackets 12 and 13, and a print head carriage 16 travels bidirectionally on the front-to-back axis Y along these carriage guide rails 14 and 15. An inkjet head 17 is mounted facing down on the head carriage 16. A carriage movement mechanism (head movement mechanism) not shown moves the head carriage 16 bidirectionally on the front-to-back axis Y along the carriage guide rails 14 and 15. A common carriage movement mechanism is used.

The downward-facing nozzle surface 17*a* of the inkjet head 17 opposes a rectangular window 11*b* that is long on the front-to-back axis Y in the printer frame 11. A media tray 21 is disposed so that it can move on both the front-to-back axis Y and the widthwise axis X of the printer below this window 11*b*.

The media tray 21 has a shallow circular recess 21*a* formed in the top of a rectangular plate for holding a CD or other disc-shaped media 2. This media tray 21 is supported slidably on the widthwise axis X of the printer over the top 22*a* of a rectangular tray support plate 22.

Guide channels or guide rails (not shown in the figure) that extend along the widthwise axis X of the printer are disposed to the top 22*a* of the tray support plate 22, and guide rails that can slide along the guide channels, or guide channels that can slide along the guide rails, are formed on the bottom of the media tray 21.

The tray support plate 22 is attached to the back of the printer frame 11 slidably on the front-to-back axis Y, or is supported slidably on the front-to-back axis Y by the frame (not shown in the figure) of the publisher 1.

The widthwise axis X of the printer is substantially perpendicular to the front-to-back axis Y.

A rack 23 extending on the widthwise axis X is formed on the end face of the media tray 21 on the back side of the printer. A tray transportation motor 24 is mounted vertically at a position at the back side of the printer frame 11, and a pinion 25 that meshes with the rack 23 is fixed to the rotating shaft 24*a* of the tray transportation motor 24. When the pinion 25 is engaged with the rack 23 the media tray 21 can be moved on the widthwise axis X by driving the tray transportation motor 24. The rack 23, the pinion 25, and the tray transportation motor 24 thus render a tray transportation mechanism.

A rack 26 extending on the front-to-back axis Y of the printer is also formed along one side edge of the tray support plate 22 along the front-to-back axis Y. A tray discharge motor 27 is attached vertically to the printer frame 11 at a position on the same side as the rack 26. A pinion 28 that meshes with the rack 26 is fixed to the rotating shaft 27*a* of the tray discharge motor 27. Driving the tray discharge motor 27 can thus move the tray support plate 22 along the front-to-back axis Y. The rack 26, the pinion 28, and the tray discharge motor 27 thus render a tray discharge mechanism.

The inkjet head 17 that travels bidirectionally on the front-to-back axis Y by means of the head carriage 16 traces a path along the widthwise center 11A of the window 11*b* in the printer frame 11. A prescribed range along this center 11A is thus the printing line (printing position) of the inkjet head 17. The tray support plate 22 that supports the media tray 21 disposed below the window 11*b* also moves bidirectionally on the front-to-back axis Y along this center 11A. When the tray support plate 22 moves the media tray 21 is positioned in the center of the tray support plate 22, and the center of the media tray 21 is aligned with the center 11A.

Figure 4:
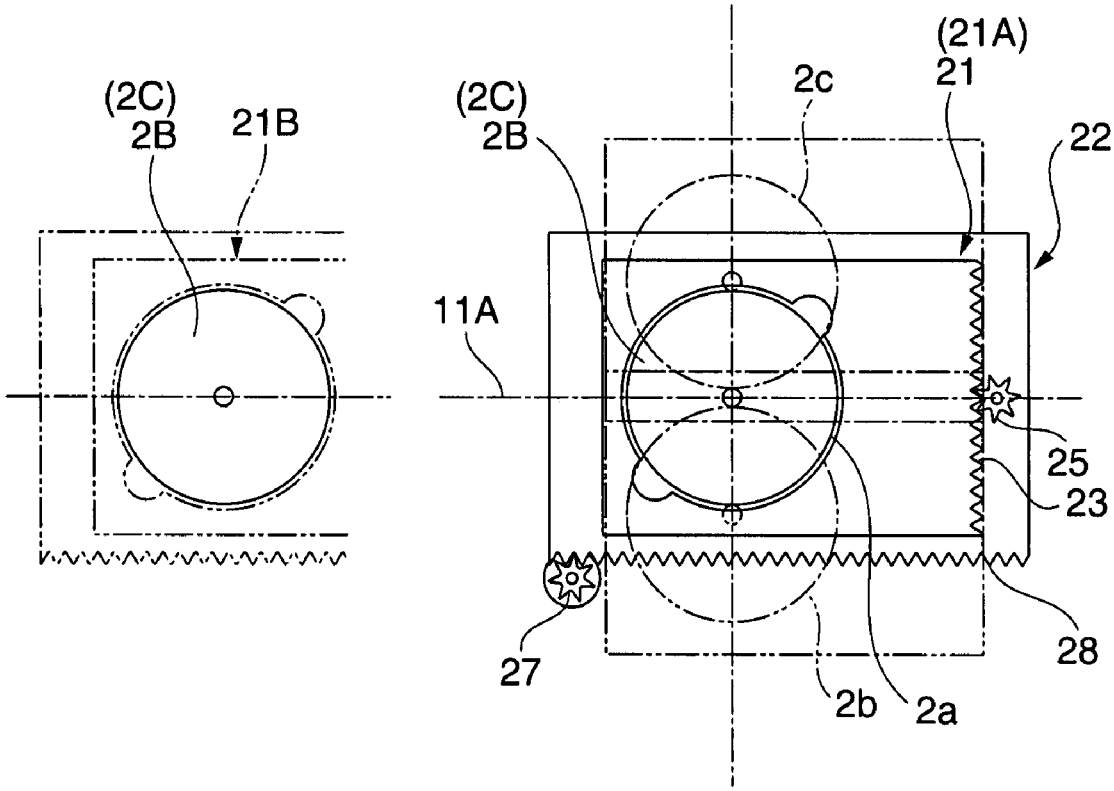
FIG. 4 describes the operation of the label printer.

FIG. 4 describes the operation of this label printer 5. The operation of the label printer 5 is described next with reference to FIG. 4.

The tray support plate 22 can move between the tray retraction position 21A where the center of the media tray 21 is positioned on the print line of the inkjet head 17 as shown in FIG. 2A, and the tray discharge position 21B where the media tray 21 is discharged to the front of the printer frame 11 as shown in FIG. 2B.

The media tray 21 is positioned at the tray discharge position 21B before the media transportation mechanism 6 delivers the written media 2B to the label printer 5. The media tray 21 receives the written media 2B from the media transportation mechanism 6 into the recess 21*a* when in this position 21B. After the written media 2B is received, the tray discharge motor 27 is driven to move the tray support plate 22 to the back of the printer so that the media tray 21 supported in the center on the top of the tray support plate 22 is positioned to the tray retraction position 21A inside the printer as shown in FIG. 2A.

The operation of retracting the media tray 21 into the printer positions the written media 2B that is on the media tray 21 on the printing line of the inkjet head 17. The rack 23 of the media tray 21 meshes with the pinion 25 on the tray transportation motor 24 as shown in FIG. 3 and FIG. 4 when the media tray 21 is positioned to the tray retraction position 21A.

FIG. 5 shows the media tray in the discharged position, and FIG. 6 shows a plan view and a front view of the main parts of the label printer when printing ends. These figures are referred to below.

When the media tray is being retracted into the printer, the media tray 21 is prevented from moving on the widthwise axis X by guide members 32 on both sides. These guide members 32 support the sides of the media tray 21 and are positioned on both sides of a line (such as center 11A) that is parallel to the front-to-back axis Y and passes the top of the media tray 21. When the media tray 21 is retracted to the position where the rack 23 at the back end of the media tray 21 meshes with the pinion 25 on the tray transportation motor 24 (the tray retraction position 21A), the media tray 21 is not impeded by the guide members 32 and can move on the widthwise axis X of the printer.

As the media tray 21 then moves along the widthwise axis X, the inkjet head 17 prints to the surface of the written media 2B. The media tray 21 moves the radius of the written media 2B from the tray retraction position 21A to one side of the printer width. As a result, the written media 2B moves from the position indicated by the solid line 2*a* in FIG. 4 to the position indicated by the imaginary line 2*b*. Before, during, or after this movement the inkjet head 17 is positioned to the printing start position on the center line 11A.

The tray transportation motor 24 is then driven, the media tray 21 moves the diameter of the written media 2B widthwise to the printer, and the inkjet head 17 prints on the surface of the written media 2B synchronized to this movement while moving along the front-to-back axis Y of the printer. When printing ends the printed finished media 2C has moved to the position indicated by the imaginary line 2*c* in FIG. 4.

As will be understood from FIG. 6, when the head carriage 16 moves to the standby position at the back of the printer, the nozzle surface 17*a* is covered by a cap 33 disposed below the standby position for capping the nozzle surface 17*a* of the inkjet head 17 to prevent the ink from drying.

The media tray 21 then moves widthwise to the printer so that the finished media 2C goes to the position indicated by solid line 2*a* in FIG. 4 (the tray retraction position 21A). The tray discharge motor 27 is then driven to move the tray support plate 22 to the front of the printer so that the media tray 21 is driven to the tray discharge position 21B. This completes the printing operation.

As described above the label printer 5 of a publisher 1 according to this embodiment of the invention aligns the direction in which the media tray 21 is discharged from and retracted into the printer and the direction of inkjet head 17 movement on the same line (center 11A) so that when the media tray 21 moves to the tray retraction position 21A the written media 2B on the media tray 21 is positioned on the printing line of the inkjet head 17. The printer according to the present invention therefore does not need to transport the media tray 21 retracted into the printer widthwise to the printer from the tray retraction position 21A to the printing position.

The printer of the invention can therefore immediately execute the printing operation while moving the media tray 21 from the tray retraction position 21A along the widthwise axis X of the printer. The distance the media tray 21 travels on the widthwise axis X during printing is therefore at most the diameter of the written media 2B. As will be understood from FIG. 4, the printer requires only enough space for the media tray 21 to move twice the diameter of the written media 2B widthwise to the printer, and is therefore extremely advantageous for rendering a label printer 5 with a compact width.

Because this embodiment of the invention affords a label printer 5 with a narrow width, a publisher 1 that incorporates the label printer 5 can also be rendered compactly.

The label printer 5 can be rendered inside the publisher 1 frame as described above, and can alternatively be rendered on the top on the outside of the publisher 1 frame, for example. In this case the printer components are assembled inside a flat, rectangular printer case 30 that is long front-to-back as indicated by the imaginary line in FIG. 2, a tray opening 31 can be formed in the front of the printer case 30, and the media tray 21 can be driven through this tray opening 31 to the front of the printer. The label printer 5 can also be installed so that the front of the printer case 30 is the front of the publisher 1 housing, that is, so that the direction in which the media tray 21 travels in and out of the printer is the same as the front to back direction of the publisher 1.

An inkjet head 17 is used as the print head by way of example above, but a print head other than an inkjet head can be used instead.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a print head;

a head movement mechanism that moves the print head;

a media tray on which media to be printed is placed;

a tray transportation mechanism that transports the media tray in a first direction that is substantially different from the direction in which the print head moves; and a tray discharge mechanism that moves the media tray in a second direction, substantially parallel to the direction in which the print head moves, between a tray discharge position outside of a printing position and a tray retraction position inside of the printing position such that a path of print head travel and a path of media tray travel in the second direction between the tray discharge position and the tray retraction position partially overlap, and such that when the media tray is in the tray retraction position the media tray is aligned with the path of print head travel.

2. The printer described in claim 1, further comprising:

a tray discharge opening formed in the printer front;

wherein the tray discharge position is a position where the media tray is discharged outside the printer from the tray discharge opening.

3. The printer described in claim 2, wherein:

the direction of print head movement is the front-to-back direction of the printer; and the direction of media tray transportation by the tray transportation mechanism is widthwise to the printer.

4. The printer described in claim 3, further comprising:

a cap that covers the print head at the back of the printer opposite the tray discharge opening formed in the printer front.

5. The printer described in claim 4, wherein:

the tray discharge mechanism includes a tray support plate that supports the media tray slidably widthwise to the printer;

a support plate guide that supports the tray support plate slidably front-to-back to the printer;

a first transportation motor; and a first rack and pinion mechanism that converts and transfers the rotational force of the first transportation motor to a linear force that moves the tray support plate in the front-to-back direction of the printer; and the tray transportation mechanism includes a second transportation motor mounted on the tray support plate; and a second rack and pinion mechanism that converts and transfers the rotational force of the second transportation motor to a linear force that moves the media tray widthwise to the printer.

6. The printer described in claim 5, further comprising a guide member for preventing the media tray from moving widthwise to the printer in the media tray transportation direction while the media tray is moving front-to-back to the printer.

7. The printer described in claim 6, wherein the guide member is positioned on both sides of a line parallel to the front-to-back direction of the printer above the media tray.

8. A media processing device comprising:

a media storage unit that stores media such as CDs and DVDs;

a media drive that writes data to the media and reads data from the media;

a label printer that prints on a surface of the media; and a media transportation mechanism that conveys the media;

wherein the label printer comprises a print head;

a head movement mechanism that moves the print head;

a media tray on which media to be printed is placed;

a tray transportation mechanism that transports the media tray in a first direction that is substantially different from the direction in which the print head moves; and a tray discharge mechanism that moves the media tray in a second direction, substantially parallel to the direction in which the print head moves, between a tray discharge position outside of a printing position and a tray retraction position inside of the printing position such that the width of the printer is aligned with the width of the media processing device, and such that when the media tray is in the tray retraction position the media tray is aligned with the path of print head travel.

* * * * *